US008596750B2

(12) United States Patent
Yu

(10) Patent No.: US 8,596,750 B2
(45) Date of Patent: Dec. 3, 2013

(54) CONTINUOUS INKJET PRINTER CLEANING METHOD

(75) Inventor: Zhiquan Yu, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/410,631

(22) Filed: Mar. 2, 2012

(65) Prior Publication Data

US 2013/0229457 A1 Sep. 5, 2013

(51) Int. Cl.
*B41J 2/165* (2006.01)
*B41J 2/185* (2006.01)

(52) U.S. Cl.
USPC ..... 347/25

(58) Field of Classification Search
USPC ..... 347/25
See application file for complete search history.

(56) References Cited

U.S. PATENT DOCUMENTS 4,362,572 A * 12/1982 Wallace ..... 134/18
4,591,873 A * 5/1986 McCann et al. ..... 347/25
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
7,967,423 B2 6/2011 Katerberg
8,091,991 B2 1/2012 Hanchak et al.
8,128,196 B2 3/2012 Garbacz et al.
2009/0295880 A1 * 12/2009 Hanchak et al. ..... 347/77

* cited by examiner

*Primary Examiner* — Matthew Luu
*Assistant Examiner* — Alexander D Shenderov
(74) *Attorney, Agent, or Firm* — William R. Zimmerli

(57) ABSTRACT

A method of maintaining a printhead includes providing a jetting module including a plurality of nozzles and a drop forming mechanism associated with the plurality of nozzles. A gas flow deflection mechanism is provided and includes a gas flow duct in fluid communication with a gas flow pressure source. A flow of liquid is provided through the nozzles at a pressure sufficient to form jets of the liquid. Liquid drops are formed from the liquid jets using the drop forming mechanism. At least some of the liquid drops are caused to enter the gas flow duct using the gas flow pressure source. Liquid from the liquid drops that entered the gas flow duct is caused to wet at least a portion of the gas flow duct. The liquid is removed from the gas flow duct.

11 Claims, 6 Drawing Sheets

CONTINUOUS INKJET PRINTER CLEANING METHOD

FIELD OF THE INVENTION

This invention relates generally to the field of digitally controlled printing devices, and in particular to continuous printing systems in which a liquid stream breaks into droplets that are deflected by a gas flow.

BACKGROUND OF THE INVENTION

Continuous stream ink jet printing uses a pressurized ink source to supply ink to one or more nozzles to produce a continuous stream of ink from each of the nozzles. Stimulation devices, such as heaters positioned around the nozzle, stimulate the streams of ink to break up into drops with either relatively large volumes or relatively small volumes. These drops are then directed by one of several systems including, for example, electrostatic deflection or gas flow deflection devices.

In printheads that include gas flow deflection systems, the drop deflecting gas flow is produced at least in part by a gas, typically air, drawn laterally across the drop trajectories into a negative gas flow duct as a result of vacuum applied to the duct. Drops of a predetermined small volume are deflected more than drops of a predetermined large volume. This allows for the small drops to be deflected into an ink capturing mechanism (catcher, interceptor, gutter, etc.) where they are either recycled or discarded. The large drops are allowed to strike the print medium. Alternatively, the small drops may be allowed to strike the print medium while the larger drops are collected in the ink capturing mechanism It has been determined that while small drops are deflected by the lateral airflow more than large drops, not all small drops follow the same trajectory. Some of these drops can be deflected sufficiently by the air flow such that they enter the gas flow duct, causing ink puddles to form. Ink puddles in the gas flow duct can also be formed during startup and shutdown of the printhead, caused by ink dripping off the upper wall of the gas flow duct and landing on the lower wall of the gas flow duct. Additionally, ink puddles can be formed due to a crooked jet which causes ink to be directed into the gas flow duct. Ink from the puddles of ink in the gas flow duct can be dragged by the gas flow up into the vacuum source that is attached to the gas flow duct, possibly damaging the vacuum source. If the ink puddles remain close to the entrance to the duct, these puddles can affect the uniformity of the air flow across the width of the jet array. Ink puddles can induce oscillations in the gas flow that can produce a modulation in the print drop trajectories that adversely affect print quality.

U.S. Pat. No. 8,091,991 described a drain for removing such ink from the negative gas flow duct and also a method for cleaning the negative gas flow duct. It has been determined that under certain operating conditions fine satellite drops or mist can be formed. The fine satellite drops, having much less volume than either the large or small drops, are deflected by the gas flow much more than the large or small drops. The deflection of these satellite drops can be sufficient to cause them to be ingested into the negative gas flow duct, and for them to remain air borne past the duct drain. The satellite drops can collide with the walls of the gas flow duct downstream of the duct drain where they form a deposit on the walls of the gas flow duct. These deposits can build up so that they interfere with the normal operation of the printhead.

Accordingly, a need exists to remove such deposits from the interior of the negative gas flow duct, and in particular to remove such deposits from portions of the negative gas flow duct downstream of the duct drain, to reduce or even prevent a degradation of the operation of the printhead.

SUMMARY OF THE INVENTION

According to one aspect of the present invention, a method of maintaining a printhead includes providing a jetting module including a plurality of nozzles and a drop forming mechanism associated with the plurality of nozzles. A gas flow deflection mechanism is provided and includes a gas flow duct in fluid communication with a gas flow pressure source. A flow of liquid is provided through the plurality of nozzles of the jetting module at a pressure sufficient to form jets of the liquid through the plurality of nozzles. Liquid drops are formed from the liquid jets using the drop forming mechanism. At least some of the liquid drops are caused to enter the gas flow duct using the gas flow pressure source. Liquid from the liquid drops that entered the gas flow duct is caused to wet at least a portion of the gas flow duct. The gas flow pressure source is deactivated after a period of time. The liquid is removed from the gas flow duct.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
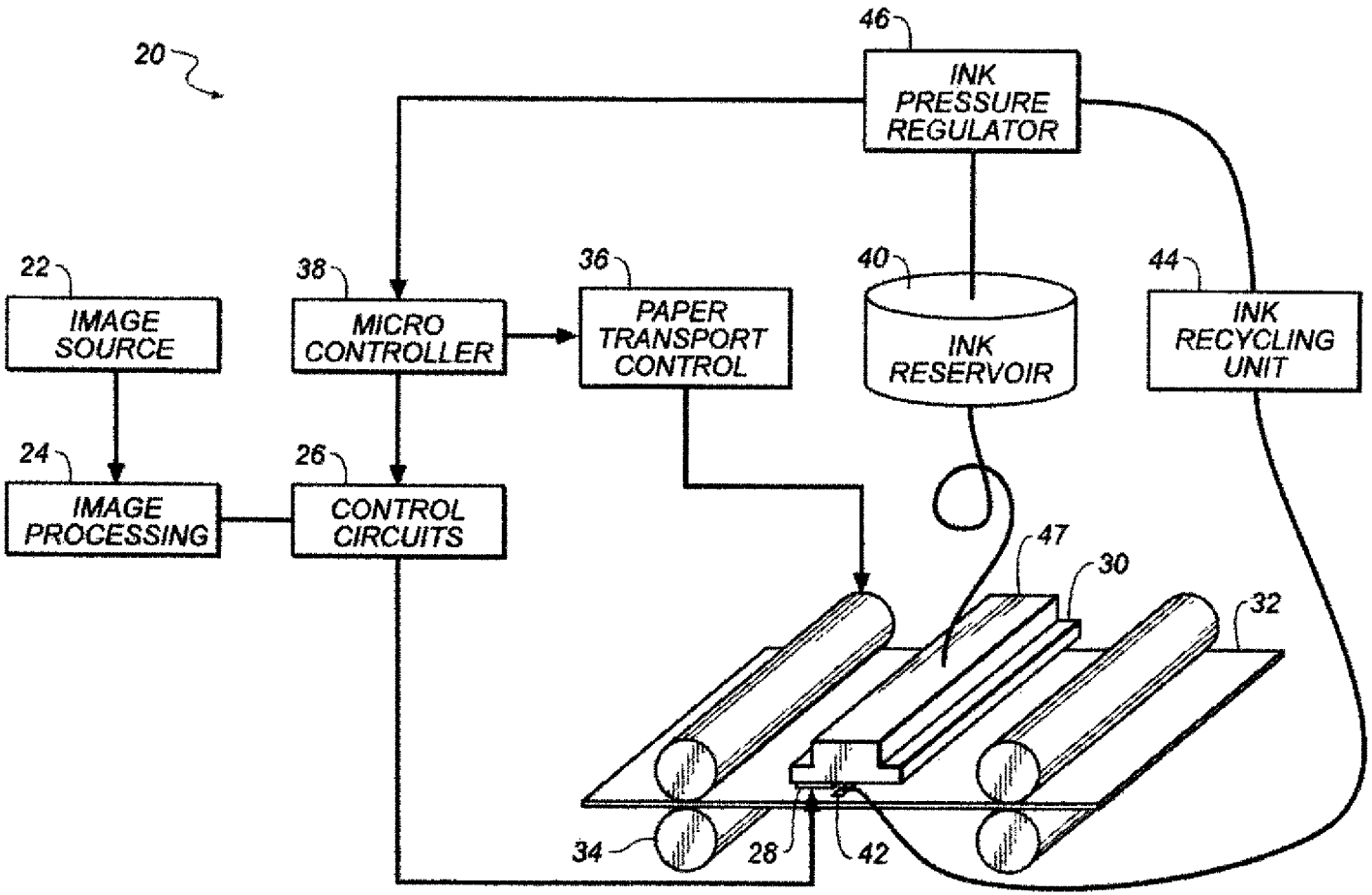
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in HG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the main scanning direction) and the recording medium along an orthogonal axis (the sub-scanning direction) in a relative raster motion.

Ink is contained in an ink reservoir 40 under pressure. When the image data doesn't call for printing a drop on the recording medium, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1), which is described in more detail below with reference to FIGS. 2 and 3.

Figure 2:
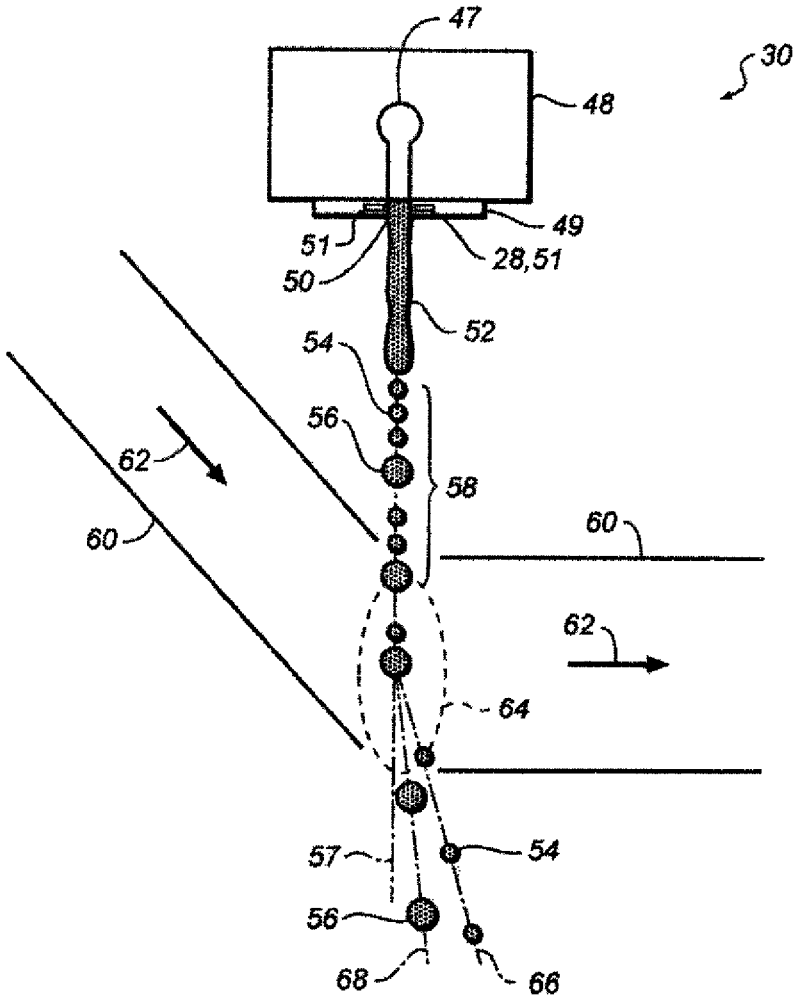
FIG. 2 is a schematic view of an example embodiment of a continuous printhead made in accordance with the present invention.
Figure 3:
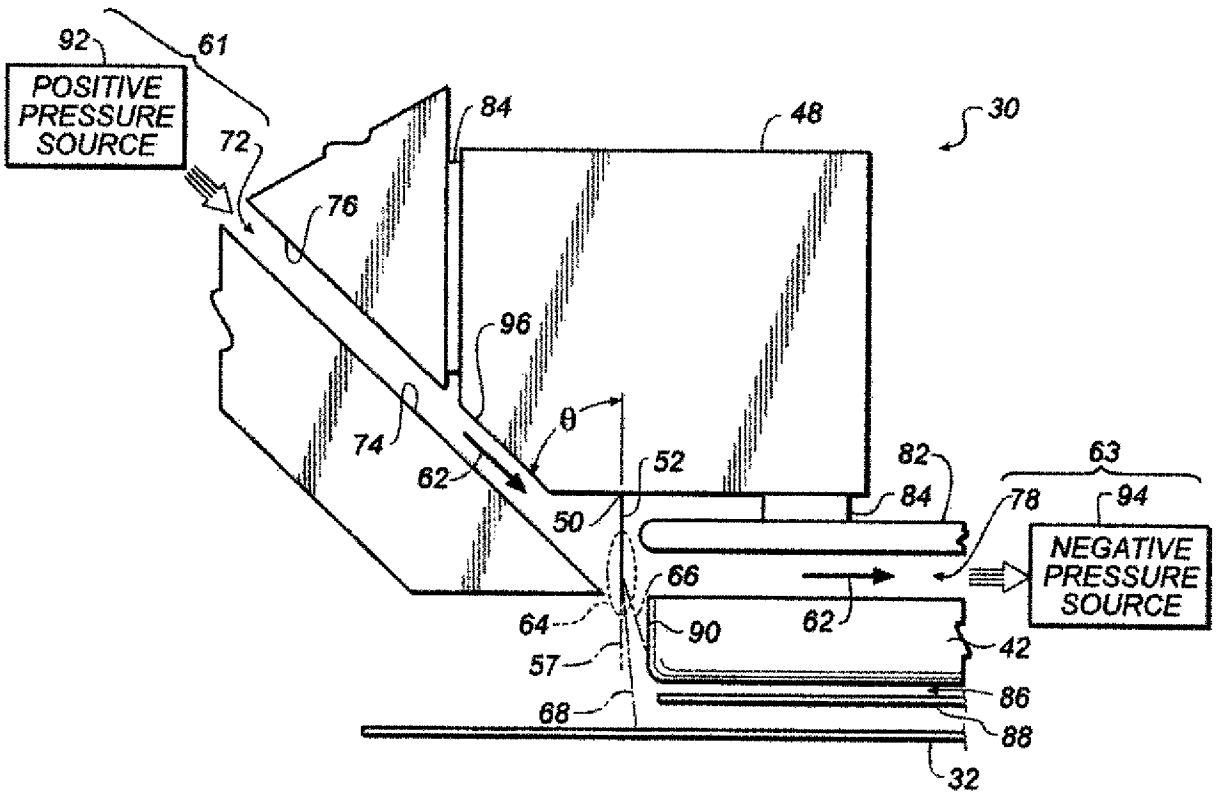
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, the nozzle plate can be integrally formed with jetting module 48.

Liquid, for example, ink, is emitted under pressure through each nozzle 50 of the array to form filaments of liquid 52. In FIGS. 2-5, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to break off from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64, it alters the drop trajectories. As the drop trajectories pass out of the deflection zone 64, they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode.

When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes positive gas flow duct 72 that includes a lower wall 74 and an upper wall 76. Gas flow duct 72 directs gas flow 62 supplied from a positive pressure source 92 at downward angle 0 of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a negative gas flow duct 78 located between catcher 42 and an upper wall 82 that exhausts gas flow from deflection zone 64. The negative gas flow duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by positive gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
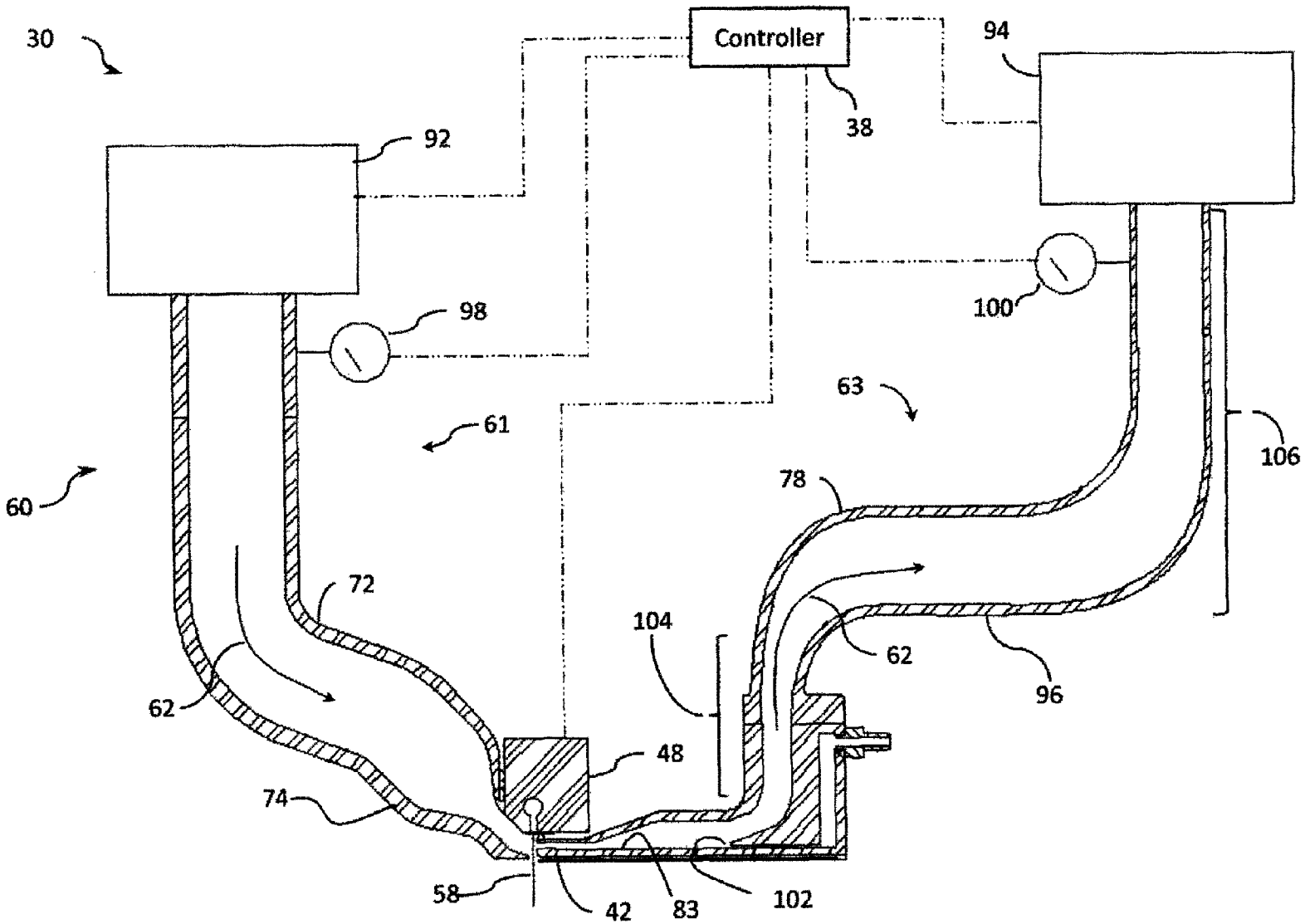
FIG. 4 is a schematic cross section view of a continuous inkjet printhead made in accordance with the present invention.

FIG. 4 provides a broader cross section view of a printhead 30 than that of FIG. 3 to show more of the gas flow ducts. From the plurality of nozzles of the jetting module 48, streams of drops 58 are created. A gas flow deflection mechanism 60 made up of a positive pressure gas flow structure 61 and a negative pressure gas flow structure 63 directs a flow of gas across the trajectories of the drop streams 58. The positive pressure gas flow structure 61 includes a positive pressure source 92 that produces a flow of gas through the positive gas flow duct 72, directed toward the trajectories of the drop streams. The positive pressure gas flow structure 61 can also include a first flow meter 98 to monitor the flow rate of the supplied gas flow. The negative gas flow structure 63 includes a negative pressure source 94 that draws a flow of gas through the negative gas flow duct 78. A second gas flow meter 100 can be included to monitor the flow rate of the gas through the negative gas flow duct 78. The micro-controller 38 can make use of the output from the first and second gas flow meters 98, 100 as feedback in its control of the positive and negative pressure sources 92, 94.

Under some conditions, a fine mist of ink drops can be created. The fine mist drops have much smaller mass than the large or small drops created as a result of the action of the heater or other drop forming device associated with each nozzle. Due to their much smaller mass, these mist drops are deflected to a much greater extent than the large or small drops by the gas flow deflection mechanism, and some of the mist drops can be ingested into the negative gas flow duct 78. Ink mist that strikes the lower wall 83 of the negative gas flow duct 78 can be removed from the duct through the duct drain 102. Ink mist that strikes the other surfaces in the lower portion 104 of the negative gas flow duct 78 can also be removed through the cleaning process described in U.S. Pat. No. 8,091,991, in which a cleaning fluid is introduced into the negative gas flow duct 78 by means of the duct drain 102, and is subsequently removed, taking with it ink mist and other debris from the lower walls of the negative gas flow duct 78.

It has been found, however, that some of the ink mist remains air borne past the duct drain, striking the upper portions 106 of the walls 96 of the negative gas flow duct 78, beyond that which can be cleaned by the cleaning process of U.S. Pat. No. 8,091,991. This mist can dry on the walls leaving a buildup of dried ink on the walls. The present invention removes this dried ink from the walls of the negative gas flow duct 78 by using the jetting module to generate mist, and ingesting the mist into the negative gas flow duct at a rate sufficient to wet and rinse down the portions of the wall of the negative gas flow duct that are to be cleaned.

The duct cleaning operation involves supplying a liquid to the jetting module at a pressure sufficient to form jets of the liquid from the nozzles of the jetting module. Typically, the supplied liquid is a cleaning liquid that includes solvents for redispersing or redissolving the dried ink residues. Typically, the cleaning liquid doesn't include colorants such as dyes or pigments. The liquid is typically supplied at a pressure below that used during the printing operation. In one preferred embodiment, the liquid is supplied at a pressure of 30 psi for this cleaning operation, whereas a pressure of 60 psi is used during printing operations. The drop forming device 28 is activated to break the jets of liquid into liquid drops, a process known as stimulation. The stimulation amplitude and frequency level can be the same as used for printing operation, but other amplitudes and frequencies can also be used. The drops generated by the stimulation process are, due to the reduced pressure, smaller than that of either the large volume drops or the small volume drops created during the print mode of operation.

A gas flow is established through the deflection zone 64 and in the negative gas flow duct 78 which causes at least a portion of the liquid drops to enter the negative gas flow duct. The gas flow is established by energizing at a gas flow pressure source associated with either the positive pressure gas flow structure or the negative gas flow structure; that is, either the positive pressure source 92 or the negative pressure source 94. The liquid from the liquid ducts wets at least of a portion of the gas flow duct, to dissolve the buildup of ink inside the gas flow duct. The gas flow pressure source is deactivated after a period of time, and the liquid with dissolved ink buildup is then removed from the gas flow duct.

In one embodiment, the positive pressure source 92 is activated to provide a flow of gas through the positive gas flow duct 72 toward the liquid drops created by the drop forming mechanism 28. This flow of gas, typically air, deflects the liquid drops, causing at least a portion of the liquid drops to be deflected into the negative gas flow duct 78. At least a portion of the gas flow, provided by the positive pressure source, passes through the negative gas flow duct 78, carrying with it the liquid drops that were ingested into the negative gas flow duct 78. The gas flow can pass through the negative pressure source even when the negative pressure source is not activated. The momentum of the liquid drops entrained by the gas flow causes the liquid drops to strike a wall of the gas flow duct as the gas flows through the gas flow duct 78. While the positive pressure source is activated to cause the liquid drops to be ingested into the gas flow duct, the duct drain is typically closed using a valve so that more of the ingested liquid is available cleaning of the walls of the gas flow duct. Due to the high rate at which liquid drops are ingested into the negative gas flow duct, and strike the walls of the gas flow duct, the liquid of the drops quickly builds up on and wets the walls of the gas flow duct. The liquid which wets the walls can begin to dissolve and rinse ink mist buildup and other debris off the walls of the negative gas flow duct.

Figure 5:
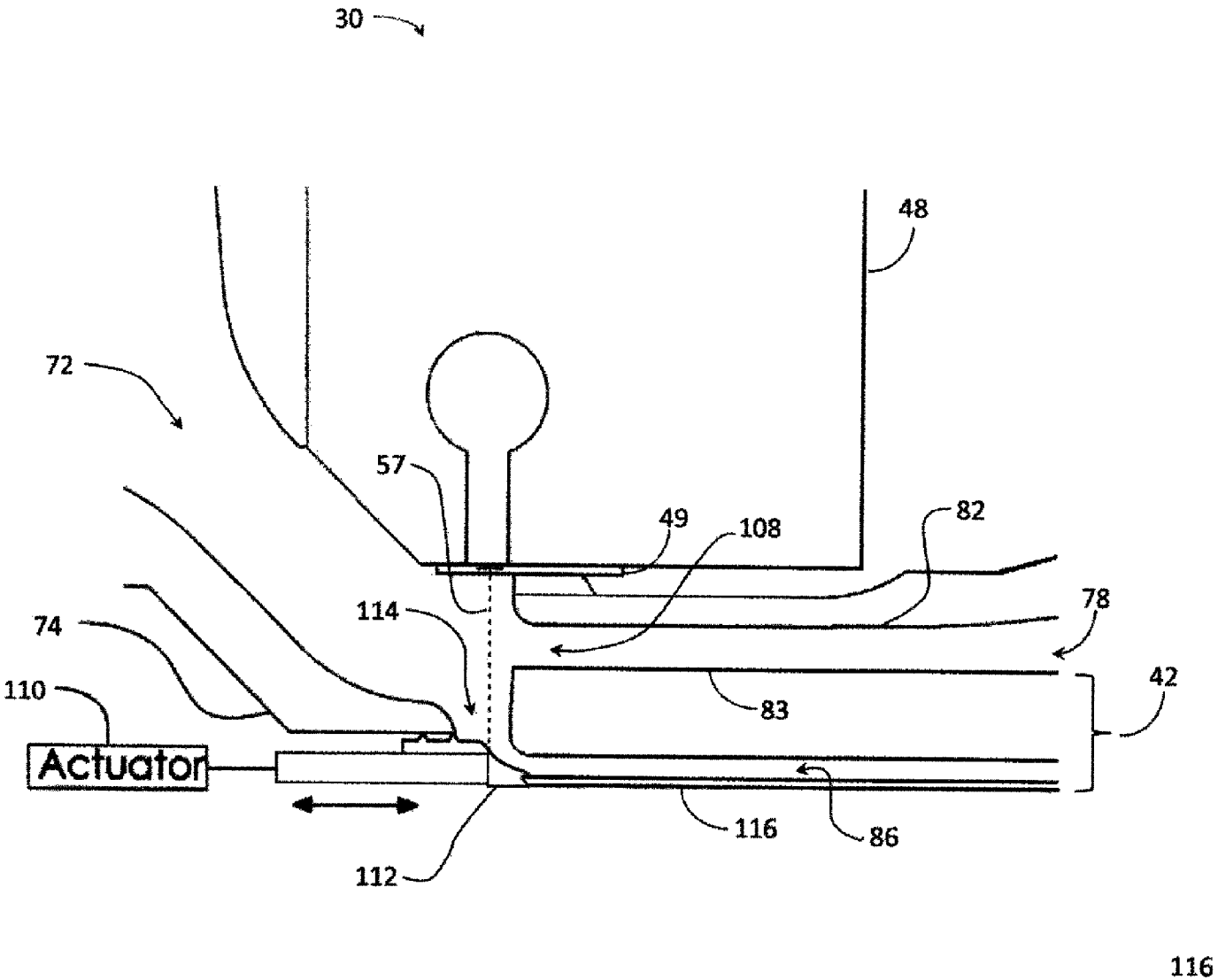
FIG. 5 shows the method steps carried out to clean the negative gas flow duct in accordance with the present invention.

During this cleaning process or cleaning mode of operation, while the liquid drops are being generated and a portion of which are being ingested into the gas flow duct, the printhead outlet 114 through which, during printing mode of operation, print drops pass on their way to the recording medium is typically sealed off as is shown in FIG. 5. The sealing of the outlet is accomplished by an actuator 110 pushing the sealing member 112 across the outlet 114 to a closed position, where the sealing member engages and seals against the lower plate 116 of the catcher 42. The sealing member 112 also contacts and seals against the lower wall 74 of the positive gas flow duct 72. With the printhead outlet sealed in this manner, the liquid drops created by the drop forming mechanism are contained within the printhead 30. The liquid drops that are not ingested into the negative gas flow duct 78 are diverted by the sealing member 112 into the liquid return duct 86 of the catcher 42 through which they are removed from the printhead. Sealing the outlet also causes more of the gas flow from the positive pressure source 92 to be directed into the negative gas flow duct 78, increasing the effectiveness of the gas flow in carrying the drops of cleaning liquid deep into the negative gas flow duct for cleaning the walls of the duct. In embodiments in which the negative pressure source is activated instead of the positive pressure source, closing the outlet by means of the sealing member serves to reduce the risk of contaminants being drawn into the printhead through the outlet by the gas flow into the negative gas flow duct. Subsequent to the cleaning process, when the printer is in the print mode of operation, the actuator 110 retracts the sealing member 112 to an open position, removed from the catcher, to enable print drops to pass through the outlet so that they can print on the recording medium.

After a period of time, typically ranging from 10 seconds to 2 minutes, and more preferably 20 to 60 seconds, the positive pressure source is deactivated, causing the gas and the entrained mist to stop flowing through the negative gas flow duct 78. Concurrent with deactivating the positive or negative gas flow source, the flow of pressurized liquid to the jetting module can also be stopped along with the activation of the drop forming mechanism, so that no further liquid drops or mist are generated. With the cessations of the gas flow through the gas flow duct, the accumulated liquid on the walls of the gas flow duct is free to flow down the walls of the gas flow duct. This liquid, along with any ink or other debris that the liquid rinsed from the walls of the gas flow duct, is then drained from the gas flow duct through the duct drain 102, or alternatively out the entrance 108 of the gas flow duct 78. Vacuum applied to the duct drain and to the liquid return duct 86 of the catcher aids in removing the liquid from the gas flow duct.

Some embodiments of the invention include a dwell time between the deactivating the positive pressure source and opening the duct drain. The dwell time can be from a few seconds to up to a minute long. During the dwell time, the liquid return duct 86 of the catcher is preferably closed using a valve in the liquid return line connecting the liquid return duct to the liquid recycling unit 44. The duct drain 102 is also typically closed. The inclusion of a dwell time, between the deactivating the positive pressure source and opening the duct drain and liquid return duct of the catcher, allows more time for the accumulated to dissolve the deposits on the inside of the gas flow duct and to slowly flow down the walls of the gas flow duct. Following the dwell time, the duct drain and the catcher liquid return ducts are opened using valves in fluid lines connected to these ports. Due to the vacuum applied to the duct drain and to the liquid return duct of the catcher, gas is sucked through the negative gas flow duct and the deactivated negative pressure source in the reverse direction. This reverse flow of gas through the gas flow duct 78 accelerates the flow of the accumulated liquid down the walls of the gas flow duct and toward the duct drain 102 taking with it dissolved ink and debris from the walls of the gas flow duct. Some of the liquid can flow out of the entrance 108 of the negative gas flow duct. This liquid can be removed from the printhead through the catcher liquid return duct port 86.

In alternate embodiments, the negative pressure source can be activated instead of or in addition to the positive pressure source to cause the liquid drops to be ingested into the negative gas flow duct. Activating the negative pressure source 94 can draw mist deeper into the negative gas flow duct 78 than activating only the positive pressure source 92. As activating the negative pressure source can draw mist deeper into the gas flow duct than activating the positive pressure source, some embodiments first activate the positive pressure source to cause the liquid drops or mist generated by the jetting module to enter the gas flow duct and wet and clean the portion of the gas flow duct that is near the entrance 108 to the gas flow duct. To clean deeper into the gas flow duct, such as the upper portion 106 of the gas flow duct that are farther from or more removed from the entrance of the gas flow duct, the negative pressure source is subsequently activated instead of, or in addition to, the positive pressure source. In these embodiments, the lower portion of the gas flow duct, that is closer to the entrance of the gas flow duct, is cleaned first using the process described above, where the positive pressure source is activated for a period of time to cause the liquid drops to enter the gas flow duct to wet and clean the portion of the gas flow duct. After the lower portion of the gas flow duct, near the entrance to the gas flow duct, has been cleaned in this manner, the process is repeated; this time activating the negative pressure to cause liquid from the liquid drops that entered the gas flow duct to wet and clean the upper, deeper portions of the gas flow duct that is removed from the entrance of the gas flow duct. Using a two step cleaning process that first cleaned the lower portion 104 of the gas flow duct, enables the ingested mist to travel more freely through the gas flow duct, so that it can more effectively reach and be used to clean the upper portions 106 of the gas flow duct. In other embodiments, either one or both of the positive pressure source or the negative pressure source are activated at first one activation level and subsequently at a second activation level to provide a first pressure and a second pressure of gas in the gas flow duct to enable the liquid drops entrained by the gas flow to clean a first portion and a second portion of the negative gas flow duct.

The cleaning process described here can be carried out as part of a schedule of routine maintenance functions. The cleaning process can also be carried out in response to the detection of some characteristic of the system that indicates the presence of contamination in the negative gas flow duct. Useful characteristics include detection of unstable gas flow conditions using the flow sensor 100; monitoring the activation level of the negative pressure source required to maintain a desired gas flow rate through the negative gas flow duct which will rise as the negative gas flow duct becomes more obstructed; the output of an optical sensor in the gas flow duct which measures transmission of light through the negative gas flow duct; the output of an ultrasonic transducer(s) used to transmit and detect ultrasonic energy through either the gas flow duct or the walls of the negative gas flow duct, as the attenuation of the ultrasound or the velocity of the sound through the duct or the duct wall may depend on the level of ink buildup on the walls; and the output of an electrical capacitance or impedance sensor as these measurement can be affected by the buildup of ink inside the gas flow duct. In some embodiments, these same characteristics may be monitored during the cleaning process to determine the level of cleanliness achieved by the cleaning process. In such embodiments, additional cleaning cycles can be employed if the measured characteristics indicate the need for additional cleaning. Alternatively, the duration of the mist ingestion condition or of the dwell time can be varied based on the monitored characteristic.

Figure 6:
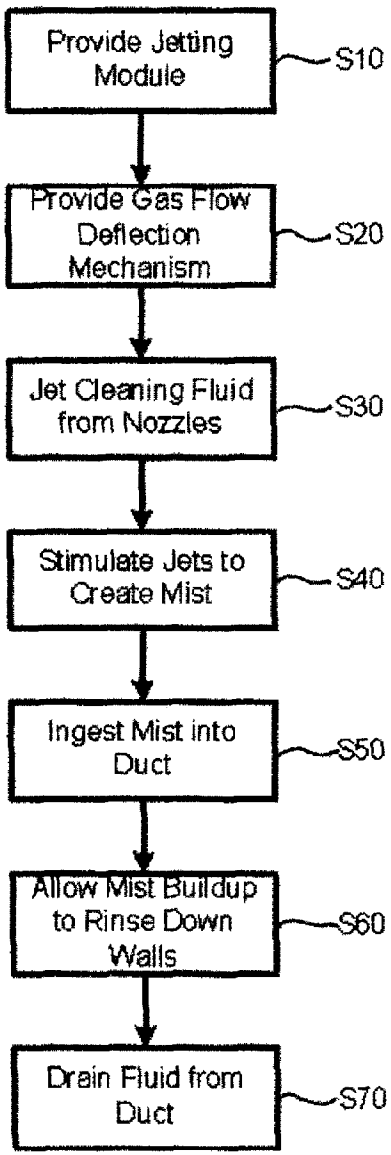
FIG. 6 is a flow chart describing a maintenance process according to the present invention.

The cleaning process is illustrated in FIG. 6 The process includes having a printhead that includes both a jetting module and a gas flow drop deflection mechanism, in steps S10, and S20. A cleaning fluid is supplied to the jetting module at a pressure sufficient to cause the cleaning fluid to jet from the nozzles of the jetting module in step S30. The drop forming devices 28 are periodically energized to stimulate the liquid jets, causing them to break into drops in step S40. The size of the drops being made is typically smaller than the drops formed during the normal operation, print mode, of the printer. The gas flow deflection mechanism is energized to cause at least a portion of the drops created by step S40 to be ingested into the gas flow duct, in step S50. The energizing of the gas flow deflection system can include energizing the positive pressure source, the negative pressure source or both. The energizing the gas flow deflection system can include energizing the gas flow deflection system at a first level to cause the instead mist to clean a first portion of the gas flow ducts, and then energizing at a second level to clean a second portion of the gas flow ducts. The rate at which the drops are ingested should be sufficient to totally wet the portions of the walls to be cleaned. The rate at which the drops are ingested is affected by at least partially by pressure of the cleaning fluid supplied to the jetting module and the frequency and energy level at which the drop forming devices are energized, which control the size of the drops created. The rate at which the drops are ingested is also dependent on the level at which the gas flow deflection source is energized. Care should be taken to avoid energizing the gas flow deflection system at too high of a level, which can cause some of the ingested drops to pass all the way through the gas flow ducts to the negative pressure source, where it could potentially damage the negative pressure source. After an appropriate period of time, the gas flow deflection system is deenergized, allowing the ingest drops or mist that built up or accumulated on the walls of the gas flow duct to flow down the walls of the gas flow duct. As the accumulated fluid flows down the duct walls it rinses the redissolved ink and other debris down the walls in step S60. The liquid is drained from the gas flow duct through the duct drain in step S70. Typically, the liquid drained from the gas flow duct through the duct drain in step S70 is directed to a waste liquid tank (not shown). Directing the soiled cleaning fluid to a waste liquid tank rather than to the ink reservoir 40, ensures that the quality of the ink in the ink reservoir from being adversely affected by the soiled cleaning fluid.

The invention has been described in detail with particular reference to certain preferred embodiments thereof, but it will be understood that variations and modifications can be effected within the scope of the invention.

Parts List

20 Continuous Printer System
22 Image Source
24 Image Processing Unit
26 Mechanism Control Circuits
28 Device
30 Printhead
32 Recording Medium
34 Recording Medium Transport System
36 Recording Medium Transport Control System
38 Micro-Controller
40 Reservoir
42 Catcher
44 Recycling Unit
46 Pressure Regulator
47 Channel
48 Jetting Module
49 Nozzle Plate
50 Plurality of Nozzles
51 Heater
52 Liquid
54 Drops
56 Drops
57 Trajectory
58 Drop Stream
60 Gas Flow Deflection Mechanism
61 Positive Pressure Gas Flow Structure
62 Gas Flow
63 Negative Pressure Gas Flow Structure
64 Deflection Zone
66 Small Drop Trajectory
68 Large Drop Trajectory
72 Positive Gas Flow Duct
74 Lower Wall
76 Upper Wall

78 Negative Gas Flow Duct
82 Upper Wall
83 Lower Wall
84 Seal
86 Liquid Return Duct
88 Plate
90 Front Face
92 Positive Pressure Source
94 Negative Pressure Source
96 Wall
98 First Gas Flow Meter
100 Second Gas Flow Meter
102 Duct Drain
104 Lower Portion
106 Upper Portion
108 Entrance
110 Actuator
112 Sealing Member
114 Outlet
116 Lower Plate
118 Lower Wall
S10 Step
S20 Step
S30 Step
S40 Step
S50 Step
S60 Step
S70 Step

The invention claimed is:

1. A method of maintaining a printhead, the printhead being configured to form liquid drops having a volume during a printing operation, comprising:

providing a jetting module including a plurality of nozzles and a drop forming mechanism associated with the plurality of nozzles;

providing a gas flow deflection mechanism including a gas flow duct in fluid communication with a gas flow pressure source, the gas flow duct including a wall;

providing a flow of liquid through the plurality of nozzles of the jetting module at a pressure sufficient to form jets of the liquid through the plurality of nozzles;

forming a mist of liquid drops from the liquid jets using the drop forming mechanism;

causing at least some of the mist of liquid drops to enter the gas flow duct using the gas flow pressure source at a rate sufficient to wet and rinse down at least a portion of the wall of the gas flow duct;

deactivating the gas flow pressure source after a period of time; and removing the liquid from the gas flow duct, wherein forming the mist of liquid drops from the liquid jets using the drop forming mechanism includes forming liquid drops having a smaller volume than the volume of the liquid drops formed during the printing operation.

2. The method of claim 1, wherein the liquid is a cleaning liquid.

3. The method of claim 1, the gas flow pressure source creating a gas flow using a gas flow pressure, wherein the pressure of the gas flow is dependent on the location of the gas flow duct to be wetted.

4. The method of claim 1, the gas flow pressure source including a positive pressure source and a negative pressure source, the gas flow duct including an entrance that is adjacent to the jetting module, wherein causing liquid from the liquid drops that entered the gas flow duct to wet at least a portion of the gas flow duct includes using the positive pressure source to cause liquid from the liquid drops that entered the gas flow duct to wet a portion of the gas flow duct that is proximate to the entrance of the gas flow duct and using the negative pressure source to cause liquid from the liquid drops that entered the gas flow duct to wet a portion of the gas flow duct that is removed from the entrance of the gas flow duct.

5. The method of claim 4, further comprising:

using the positive pressure source in addition to the negative pressure source to wet the portion of the gas flow duct that is removed from the entrance of the gas flow duct.

6. The method of claim 1, the gas flow pressure source including a negative pressure source, the gas flow duct including an entrance that is adjacent to the jetting module, wherein causing liquid from the liquid drops that entered the gas flow duct to wet at least a portion of the gas flow duct includes using the negative pressure source to cause liquid from the liquid drops that entered the gas flow duct to wet a portion of the gas flow duct that is proximate to the entrance of the gas flow duct.

7. The method of claim 6, further comprising:

using the negative pressure source to cause liquid from the liquid drops that entered the gas flow duct to wet a portion of the gas flow duct that is removed from the entrance of the gas flow duct.

8. The method of claim 1, further comprising:

providing the gas flow duct with a duct drain, wherein removing the liquid from the gas flow duct includes causing the liquid to flow through the duct drain.

9. The method of claim 1, the gas flow duct including an entrance, further comprising:

providing a catcher, wherein removing the liquid from the gas flow duct includes causing the liquid to flow out of the entrance of the gas flow duct and toward the catcher.

10. The method of claim 1, further comprising:

providing a catcher;

providing an sealing member having an open position removed from the catcher and a closed position in sealing contact with the catcher; and controlling the direction of gas flow generated by the gas flow pressure source by closing the sealing member prior to forming the liquid drops from the liquid jets using the drop forming mechanism drops control.

11. The method of claim 1, further comprising:

detecting a characteristic that indicates the presence of contamination in the gas flow duct prior to initiating the method of claim 1.

* * * * *